US011173409B2

(12) United States Patent
Cohen

(10) Patent No.: US 11,173,409 B2
(45) Date of Patent: Nov. 16, 2021

(54) SAFE FALLING RIDE APPARATUS AND MULTI-FEATURE GUEST ATTRACTION

(71) Applicant: Joshua S. Cohen, Heathrow, FL (US)

(72) Inventor: Joshua S. Cohen, Heathrow, FL (US)

( * ) Notice: Subject to any disclaimer, the term of this patent is extended or adjusted under 35 U.S.C. 154(b) by 0 days.

(21) Appl. No.: 17/116,655

(22) Filed: Dec. 9, 2020

(65) Prior Publication Data

US 2021/0170288 A1 Jun. 10, 2021

Related U.S. Application Data

(60) Provisional application No. 62/945,455, filed on Dec. 9, 2019.

(51) Int. Cl.
*A63G 31/00* (2006.01)

(52) U.S. Cl.
CPC ..... *A63G 31/00* (2013.01); *A63G 2031/002* (2013.01)

(58) Field of Classification Search
CPC ..... A63G 31/002; A63G 31/005; A63G 2031/002; A63G 2031/005; B64D 1/02; B64D 25/14
USPC ..... 472/2, 50, 131, 134–135; 182/48
See application file for complete search history.

(56) References Cited

U.S. PATENT DOCUMENTS 3,497,159 A * 2/1970 Lancsa ..... B64G 1/52 244/172.1
4,373,289 A * 2/1983 Douglas ..... A63H 33/00 292/200
7,182,695 B1 * 2/2007 Tostenson ..... A63B 5/11 472/133
9,005,044 B2 * 4/2015 Checketts ..... A63G 31/02 472/50

* cited by examiner

*Primary Examiner* — Kien T Nguyen
(74) *Attorney, Agent, or Firm* — Larry D. Johnson

(57) ABSTRACT

A safe falling ride apparatus may include a rigid floor with a trap door, a net in a net frame, one or more linear actuators connected to the net frame, one or more rails on which the net frame travels up or down as driven by the actuators, a control assembly, and a deformable material. At the start of a ride event, a guest is positioned on the trap door. The trap door is opened and the guest free falls until reaching the net, which catches the guest and begins a controlled descent as determined by the actuators, until the guest and the net reach the deformable material. The guest and net keep descending into the deformable material as their energy is dissipated and their speed decreased, until the guest reaches the ride end floor. The control assembly detects when the guest has left the ride, and repositions the equipment to the start position for the next guest.

12 Claims, 7 Drawing Sheets

SAFE FALLING RIDE APPARATUS AND MULTI-FEATURE GUEST ATTRACTION

CROSS REFERENCE TO RELATED APPLICATIONS

The present application claims the benefit of the filing date of U.S. Provisional Patent Application Ser. No. 62/945,455, filed Dec. 9, 2019. The foregoing application is incorporated by reference in its entirety as if fully set forth herein.

TECHNICAL FIELD

This written description relates generally to attractions and entertainment facilities, and more particularly to an improved safe falling ride apparatus, and a multi-feature guest attraction that may include a safe falling ride apparatus.

SUMMARY

Described below is a safe falling ride apparatus, and a multi-feature guest attraction that may include a safe falling ride apparatus. In some implementations, the safe falling ride apparatus includes one or more of a facility assembly including a preferably rigid floor with a trap door, a net assembly including a net in a net frame, one or more linear motion mechanisms such as linear actuators connected to the net frame, one or more rails on which the net frame travels up or down as driven by the actuators, a control assembly, and a deformable material.

In some implementations, at the start of a ride event, a guest stands or is otherwise positioned on the trap door. The trap door is opened and the guest free falls a distance until reaching the net, which catches the guest and begins a controlled descent as determined by the actuators, all the while maintaining the feeling of a "free fall" experience for the guest, until the guest and the net reach the deformable material. The guest and net keep descending into the deformable material, and with the deformable material absorbing falling energy, their energy is dissipated and their speed decreased, until the guest reaches the ride end floor. The control assembly detects when the guest has left the ride, and then repositions the equipment to the start position for the next guest.

In some implementations, one or more implementations of a safe falling ride apparatus are included in a multi-feature guest attraction having one or more sections or "rooms" providing different guest experiences.

Particular embodiments of the subject matter described in this specification can be implemented so as to realize one or more of the following advantages.

In some implementations, the safe falling ride apparatus provides a guest with an authentic "free fall" experience. In some implementations, this free fall experience is readily repeatable to accommodate subsequent guests.

In some implementations, some or all of the features within a floor plan of the multi-feature guest attraction may occur in natural light, artificial light, or in the dark, and may offer the guest an immersive, sensory experience with custom high-end special effects.

In some implementations, the multi-feature guest attraction may provide a cinema-quality audio experience that includes a score, realistic foley (sound effects), and an in-depth storyline throughout.

The details of one or more embodiments of the subject matter described in this specification are set forth in the accompanying drawings and the description below. Other features, aspects, and advantages of the subject matter will become apparent from the description, the drawings, and the claims.

Those skilled in the art will appreciate that the conception upon which this disclosure is based readily may be utilized as a basis for the designing of other structures, methods and systems that include one or more of the various features described below.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

FIGS. 3-10 illustrate a sequence of ride events that may occur in one implementation of a safe falling ride apparatus, wherein:

FIG. 3 is a view thereof at the start of a ride;

FIG. 4 is a view thereof as a trap door opens;

FIG. 5 is a view thereof at initial guest contact with a net;

FIG. 6 is a view thereof as the net travels;

FIG. 7 is a view thereof at initial guest/net contact with a deformable material;

FIG. 8 is a view thereof as the deformable material deforms;

FIG. 9 is a view thereof at the end of the ride;

FIG. 10 is a view thereof as the equipment returns to the start position.

DETAILED DESCRIPTION

Figure 1:
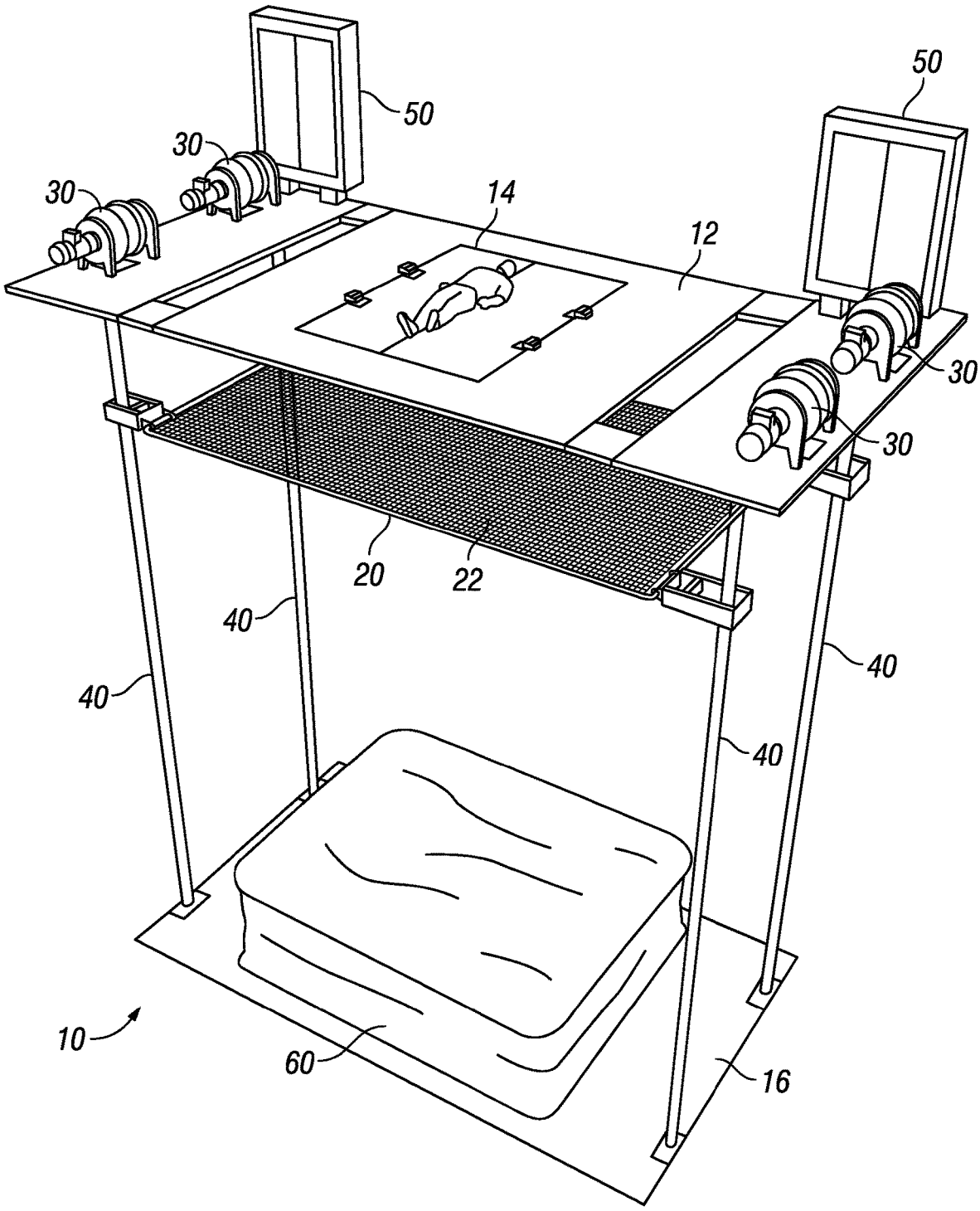
FIG. 1 is a perspective view of one implementation of a safe falling ride apparatus.

Referring to FIGS. 1 through 11, wherein like reference numerals refer to like components in the various views, there are illustrated therein implementations of a safe falling ride apparatus, and an implementation of a multi-feature guest attraction that may include one or more implementations of a safe falling ride apparatus.

FIG. 1 is a perspective view of one implementation of a safe falling ride apparatus. In some implementations, the safe falling ride apparatus 10 may include one or more of the following features or components:

1. A facility assembly, which may include one or more of a preferably rigid ride start floor 12, a trap door 14 in the ride start floor, and a ride end floor 16 a distance below the ride start floor.

2. A net assembly, which may include a net perimeter or frame 20 supporting a net 22.

3. One or more linear motion mechanisms such as actuators 30, the moving components of which are coupled to the net 22 as by connection to net frame 20. The linear motion mechanisms may be in the form of direct electric linear actuators, electro-mechanical actuators, mechanical actuators, pneumatic actuators, hydraulic actuators, telescoping linear actuators, or any other type of linear motion mechanism.

4. One or more rails 40 on which the net perimeter or frame 20 travels up or down as driven by the linear motion mechanisms 30. In some implementations, portions of the linear motion mechanisms may themselves constitute the one or more rails.

5. A controls assembly 50, which may comprise a Programmable Logic Controller/PLC Unit with associated sensors and instrumentation, and/or other controls. Portions of controls assembly 50 may be located in a cabinet or other housing on ride start floor 12 as illustrated, on a platform or other floor, placed on the rails, or any other location which may be convenient for check and maintenance access.

6. Deformable material 60 on the ride end floor, which may comprise a cushion member for absorbing at least a portion of the impact of a falling body, and which may be in the form of an inflatable air bag; a foam cushion; a net, which may be part of the net assembly or another net; or any other structure or material to safely receive the guest at the end of the ride event. In some implementations, the net assembly is able to safely stop itself before reaching the ride end floor without the use of a deformable material or another structure.

Figure 2:
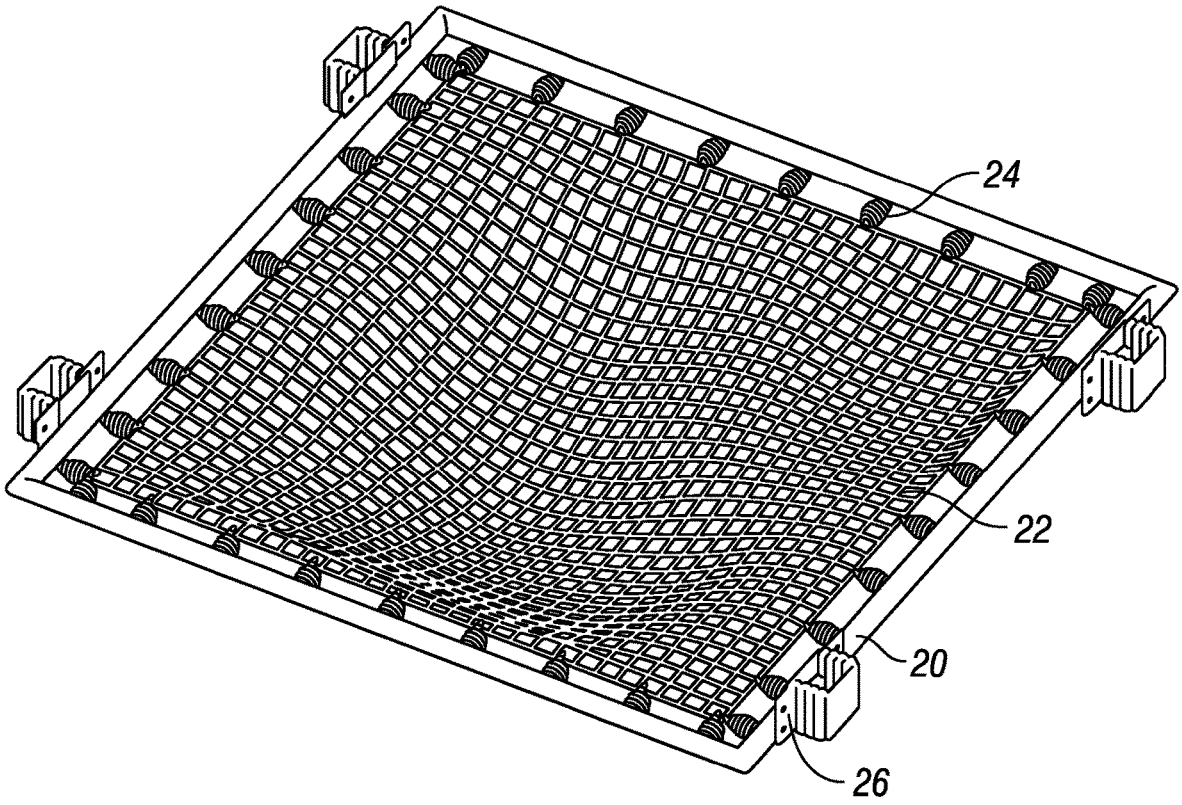
FIG. 2 is a perspective view of one implementation of a net assembly for a safe falling ride apparatus.

FIG. 2 is a perspective view of one implementation of a net assembly for a safe falling ride apparatus, including net perimeter or frame 20, which may be rigid or flexible, and which itself may include padding or other cushion material for operational safety. Net perimeter or frame 20 supports net 22, which may be constructed of squares of cargo fibers, cargo fibers with an internal mesh, or be of other net, blanket, or other material to provide a guest capture feature. Net straps and/or springs 24 may be used to secure the net 22 to the net perimeter or frame 20. In some implementations, actuator attachments 26 are connected to the net perimeter or frame 20 on one or more sides or edges thereof, and preferably on at least two opposing sides thereof, as illustrated. The net perimeter or frame and net may be of any shape, such as a generally square shape as illustrated, or may be of any other shape suitable for capture of a falling body.

FIGS. 3-10 illustrate a sequence of ride events that may occur in one implementation of a safe falling ride apparatus.

Figure 3:
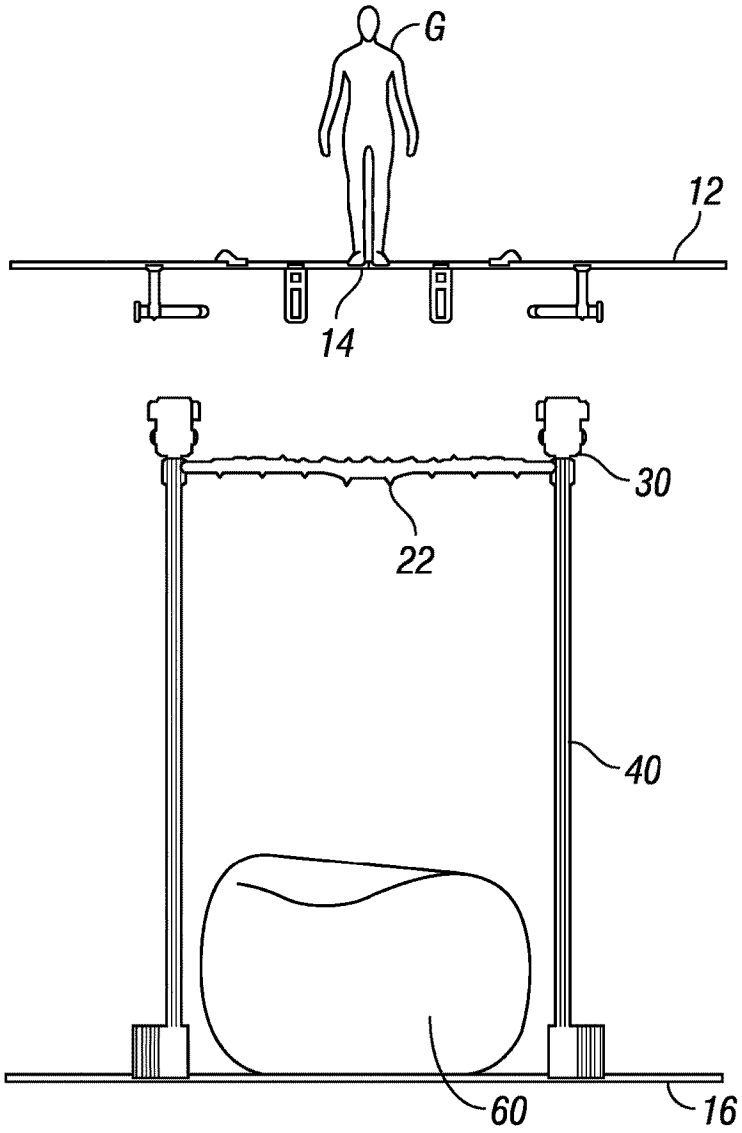

FIG. 3 is a view thereof at the start of the ride, before the drop. At the start of the ride event, the guest G may be standing, crawling, sitting, laying on their back, or in another position on the trap door 14 in the ride start floor 12. In some implementations, guest G is unharnessed and unrestrained at the top of the platform.

Figure 4:
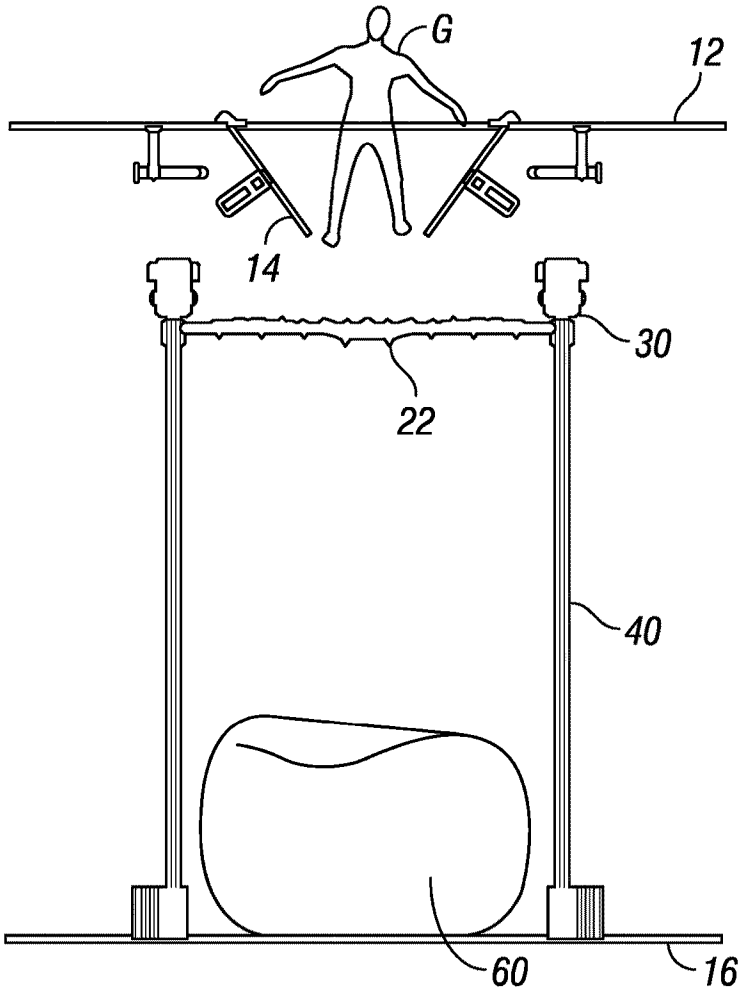

FIG. 4 is a view thereof as the trap door 14 opens. Controls 50 initiate the ride sequence by opening the trap door 14, and, in some implementations, guest G begins to free fall a distance of on the order of 5 +/− feet, or other distance, until reaching the net 22. In some implementations, the guest free fall distance is preferably from 2 to 10 feet. Since the guest is free falling in this step, his/her initial falling body position may be random and uncontrolled.

Figure 5:
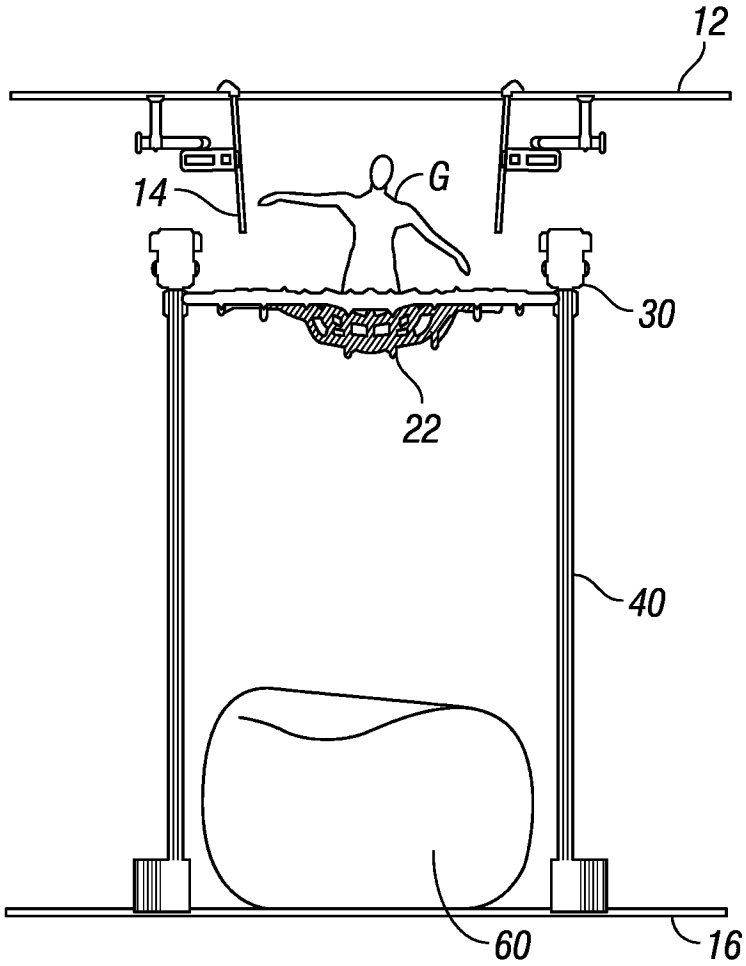

FIG. 5 is a view thereof at initial guest contact with net 22. The net 22 catches the guest G and starts a controlled descent as determined by controls 50 controlling the travel of net frame 20.

Figure 6:
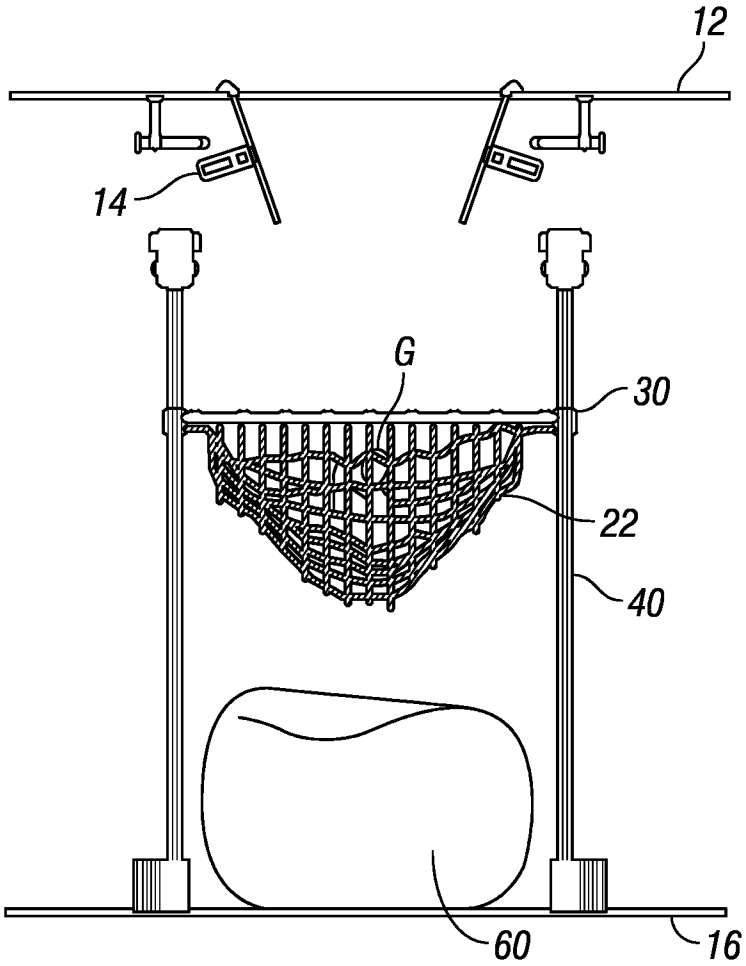

FIG. 6 is a view thereof as the net travels. The net frame 20 descends along the rail 40 at a controlled speed determined and controlled by the actuators 30 and associated controls 50. The speed is detected and measured through the controls assembly sensors, feeding a signal to the actuators 30 to adjust the descending speed into the proper range while maintaining the feeling of a "free fall" experience. In some implementations, the total distance traveled by the guest with only the net 22 may be on the order of 10 +/− feet, or other distance. In some implementations, the guest with the net fall distance is preferably from 5 to 20 feet. This gives time for the net 22 to deform and position the guest into a better fall/landing body position.

Figure 7:
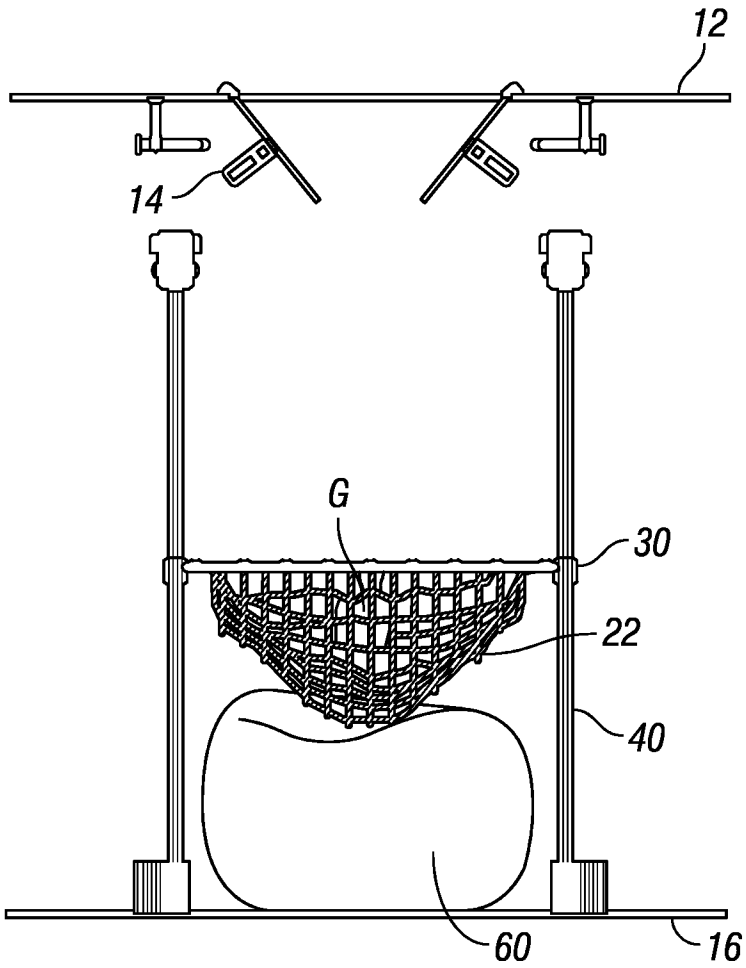

FIG. 7 is a view thereof at the initial guest/net contact with deformable material 60. The guest G and the net 22 reach the deformable material 60 which catches the guest along with those areas of the net 22 that are in contact with the guest.

Figure 8:
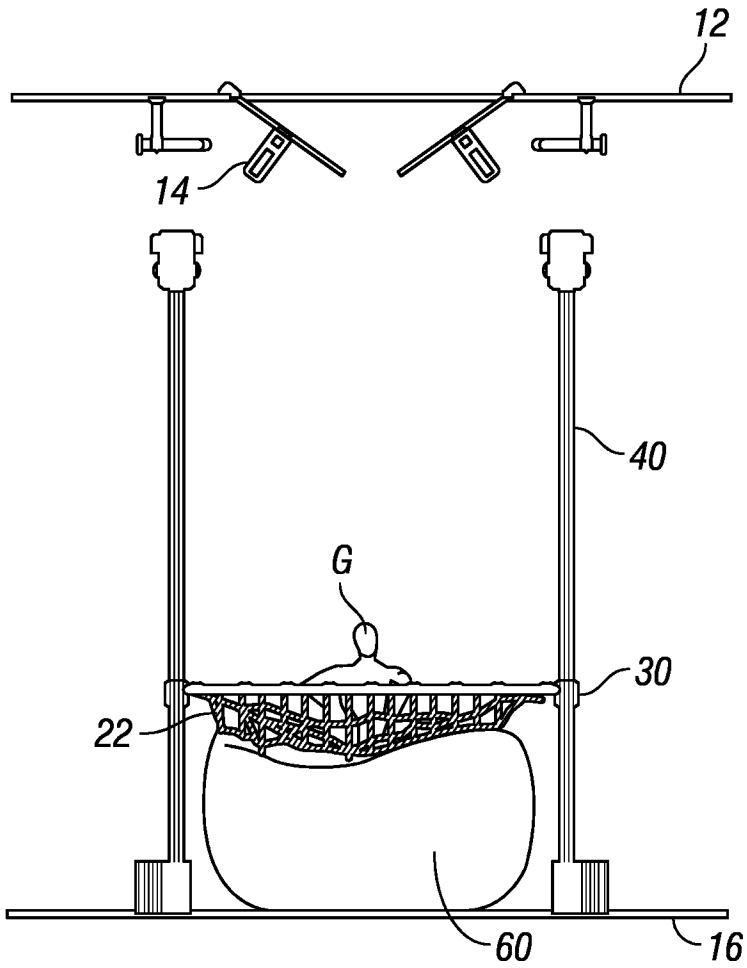

FIG. 8 is a view thereof as the deformable material 60 deforms. The guest G keeps descending along with the net 22, and with the action of the deformable material 60 absorbing falling energy, his/her energy is dissipated, decreasing their speed.

Figure 9:
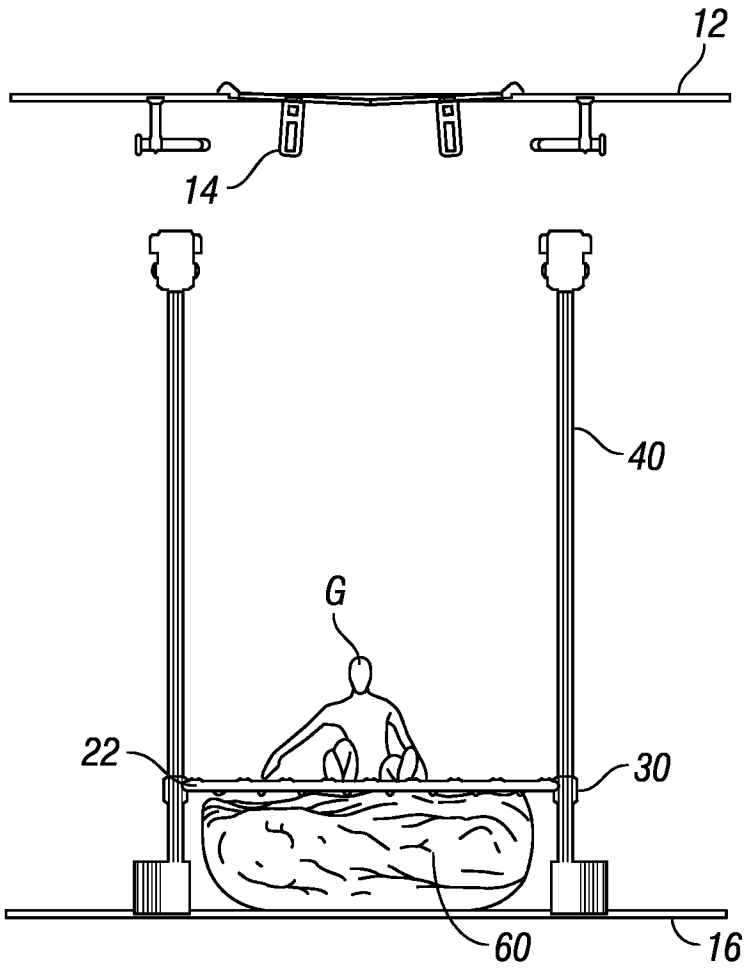

FIG. 9 is a view thereof as the drop ends. The deformable material 60 absorbs the remaining fall energy until the guest G reaches the ride end floor 16. In some implementations, the total distance traveled with the deformable material 60 may be on the order of 5 +/− feet, or other distance. In some implementations, the distance traveled with the deformable material is preferably from 2 to 10 feet.

Figure 10:
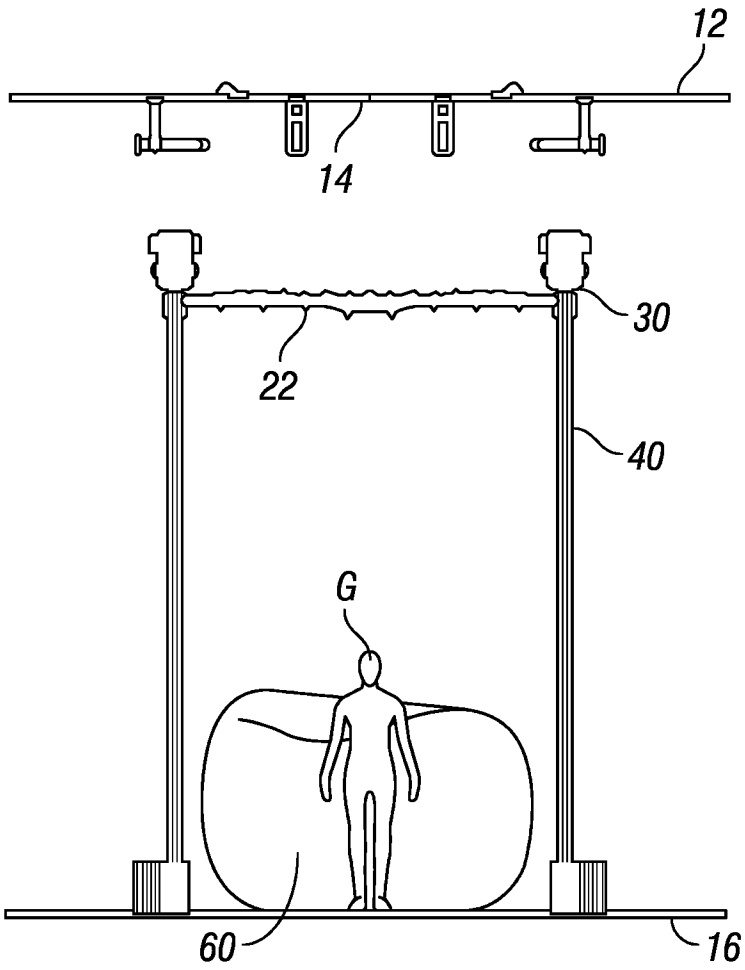

FIG. 10 is a view thereof as the equipment returns to the start position. The guest G may be instructed to exit the ride section. The controls assembly sensors and Programmable Logic Controller/PLC Unit 50 detect that the guest G has left the ride section, and proceed to reposition the equipment to the initial position for the next guest. This repositioning may include: actuators 30 ascending the net perimeter or frame 20 and net 22 to the original position, deformable material 60 re-inflating (if the air bag option is used), closing trap door 14, and Programmable Logic Controller/PLC Unit 50 starting the programmed events loop for the next guest.

Figure 11:
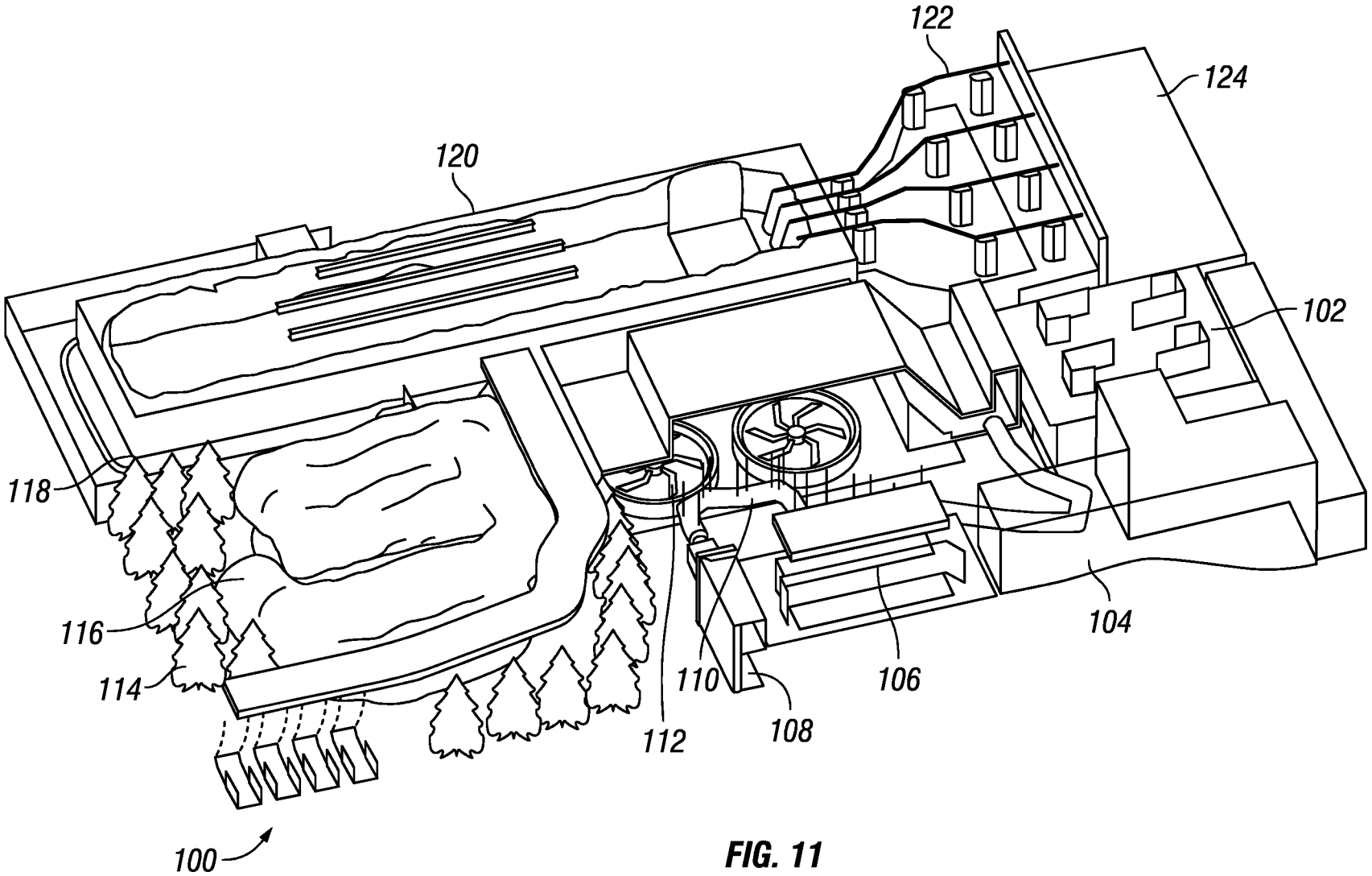
FIG. 11 is a perspective view of one implementation of a multi-feature guest attraction that may include one or more implementations of a safe falling ride apparatus.

FIG. 11 is a view of one implementation of a multi-feature guest attraction 100 that may include one or more implementations of a safe falling ride apparatus 10. The guest attraction 100 may include one or more sections or "rooms" providing different guest experiences, including but not limited to one or more of the following:

First Room 102: Guests enter a safe falling ride apparatus room that has four spots to be positioned on. The attraction begins with a 2-3 minute score and a voiceover narrative that starts the story. Two to four or more blast fog machines, as well as various lights, trigger and turn off at set times throughout. Once the voiceover concludes, guests drop through the trap door in the floor and free fall in pitch darkness. Forced air/fast blowing fans are mounted on the sides of the compartments to increase fall intensity.

Storm Hallway 104: Features extreme wind fans, particle pieces/mist, and a sloped conveyor belt (e.g., 20-25 degrees) that resists climbing, in order to provide guests with an intense "summiting" experience. A rope may be situated to the side of the conveyor belt, in order to help guests climb if necessary.

Moving Bridge 106: A horizontal bridge that swings back-and-forth at 30 degree angles, and may drop randomly at various points. Extreme wind gusts are felt by guests, and a heavy fog is present in this room, specifically located under the bridge. A thunder storm lighting effect triggers on and off within the "cloud-like" fog.

Constrictor Elevator 108: Guests enter a tight and contained elevator shaft that remains static for approximately 1 to 1.5 minutes. Realistic faux sparks emit from the ceiling of the elevator as well, and touch guests inside. After the time passes, the elevator slowly moves down and exposes a narrow opening of the next feature, which guests need to crawl through in order to proceed forward.

Drop Tube 110: Guests crawl single-file in a tube tunnel, sections of which drop up and down at various times while the guests are proceeding through. The tunnel features a combination of fog, scent, faux foliage, and textured walls in order to provide a dynamic sensory experience.

Cargo Net 112: Guests crawl up and then crawl through a central section, which ends with a trap door/free fall experience as described above, then the guests crawl further through an exit.

Forest 114: While crawling out of the cargo net room, net sections snatch guests up very fast like they were "caught", pull them up, then transport them through a faux forest section. The transport suddenly drops the guests in the forest, the net opens, and the guests walk along a path through the forest with moving vegetation and foliage, while an animatronic creature is heard for the first time. Guests then escape the forest and enter the next room.

Cave (disoriented fog) 116: Guests walk through a dark, heavily fogged tunnel that is lined with faux rock walls and floors. Animatronic creatures that were heard in the forest jump out at guests from within the walls and/or ceiling.

Slide Down Crawl 118: Guests drop out of the cave into a launch slide, and after landing, proceed to a crawl space which looks too narrow to pass through. The walls and ceiling of this passage are fabricated to blend into the scenes of the next feature, and the walls contain springs behind them that require guests to push and create space in order to proceed forward.

Collapsing Room 120: Guests crawl up and down through a tunnel and exit to a path. The path floor vibrates at various times throughout, the concrete floor cracks in pieces, while creating a "shockwave" or "earthquake" effect, overhead beams and ceiling portions fall, a concrete wall falls, and an expansion wave starts.

Grand Finale 122: Guests enter a capsule, faux fire lines the ceiling and surrounds each capsule, as faux fire explosions occur around the guests during transport. Guests are transported backwards and face the previous scene (collapsing room) while it is still imploding. Guests are transported to a safe falling ride apparatus room, the capsules open and the guests fall through the trap door, and free fall through compartments that are on fire. Forced air/fast blowing fans may be mounted on the sides of the compartments to increase fall intensity. After dropping out of the capsules and falling through the fire, guests proceed to the themed exit 124.

Accordingly, the safe falling ride may be characterized as a safe falling ride apparatus comprising a facility including a ride start floor, a trap door in the ride start floor, and a ride end floor a distance below the ride start floor; a net assembly including a net perimeter supporting a net; one or more linear motion mechanisms coupled to the net perimeter; one or more rails on which the net perimeter may travel up or down as driven by the one or more linear motion mechanisms; a controls assembly to control the one or more linear motion mechanisms to drive the net perimeter up or down the one or more rails; and a deformable material proximate the ride end floor, wherein a guest may be positioned on the trap door, and the control assembly initiates a ride sequence by opening the trap door, the guest free falls until reaching the net, the net catches the guest and starts a controlled descent as determined by the controls assembly controlling the travel of the net perimeter down the one or more rails until the guest contacts the deformable material, and the deformable material absorbs at least some portion of a fall energy of the guest.

The safe falling ride may be further characterized as a method for operating a safe falling ride including providing a facility including a ride start floor, a trap door in the ride start floor, and a ride end floor a distance below the ride start floor; providing a net assembly including a net perimeter supporting a net at a start position a distance below the trap door in the ride start floor; coupling one or more linear motion mechanisms to the net perimeter; providing one or more rails on which the net perimeter may travel up or down as driven by the one or more linear motion mechanisms; providing a controls assembly to control the one or more linear motion mechanisms to drive the net perimeter up or down the one or more rails; providing a deformable material proximate the ride end floor; positioning a guest on the trap door; initiating a ride sequence by opening the trap door and allowing the guest to free falls until reaching the net; catching the guest in the net and starting a controlled descent by controlling the travel of the net perimeter down the one or more rails until the guest contacts the deformable material; and absorbing at least some portion of a fall energy of the guest in the deformable material.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A safe falling ride apparatus comprising:

a facility including a ride start floor, a trap door in the ride start floor, and a ride end floor a distance below the ride start floor;

a net assembly including a net perimeter supporting a net;

one or more linear motion mechanisms coupled to the net perimeter;

one or more rails on which the net perimeter may travel up or down as driven by the one or more linear motion mechanisms;

a controls assembly to control the one or more linear motion mechanisms to drive the net perimeter up or down the one or more rails; and a deformable material proximate the ride end floor, wherein a guest may be positioned on the trap door, and the control assembly initiates a ride sequence by opening the trap door, the guest free falls until reaching the net, the net catches the guest and starts a controlled descent as determined by the controls assembly controlling the travel of the net perimeter down the one or more rails until the guest contacts the deformable material, and the deformable material absorbs at least some portion of a fall energy of the guest.

2. The safe falling ride apparatus of claim 1 wherein the net is constructed of one of squares of cargo fibers or cargo fibers with an internal mesh.

3. The safe falling ride apparatus of claim 1 wherein the net perimeter comprises a net frame.

4. The safe falling ride apparatus of claim 3 wherein the net assembly includes at least one of net straps or springs to secure the net to the net frame.

5. The safe falling ride apparatus of claim 1 wherein the net perimeter includes one or more attachments to couple the net perimeter to the one or more linear motion mechanisms on at least two opposing sides of the net perimeter.

6. The safe falling ride apparatus of claim 1 wherein the net perimeter is square in shape.

7. The safe falling ride apparatus of claim 1 wherein the one or more linear motion mechanisms comprise one of direct electric linear actuators, electro-mechanical actuators, mechanical actuators, pneumatic actuators, hydraulic actuators, or telescoping linear actuators.

8. The safe falling ride apparatus of claim 1 wherein the controls assembly comprises a programmable logic controller.

9. The safe falling ride apparatus of claim 1 wherein the deformable material comprises one of a cushion member for absorbing at least a portion of the impact of a falling body, an inflatable air bag, a foam cushion, or a net.

10. A method for operating a safe falling ride, the method comprising:

providing a facility including a ride start floor, a trap door in the ride start floor, and a ride end floor a distance below the ride start floor;

providing a net assembly including a net perimeter supporting a net at a start position a distance below the trap door in the ride start floor;

coupling one or more linear motion mechanisms to the net perimeter;

providing one or more rails on which the net perimeter may travel up or down as driven by the one or more linear motion mechanisms;

providing a controls assembly to control the one or more linear motion mechanisms to drive the net perimeter up or down the one or more rails;

providing a deformable material proximate the ride end floor;

positioning a guest on the trap door;

initiating a ride sequence by opening the trap door and allowing the guest to free falls until reaching the net;

catching the guest in the net and starting a controlled descent by controlling the travel of the net perimeter down the one or more rails until the guest contacts the deformable material; and absorbing at least some portion of a fall energy of the guest in the deformable material.

11. The method for operating a safe falling ride of claim 10 further including detecting when the guest has left the ride, ascending the net perimeter to the start position and closing the trap door.

12. The method for operating a safe falling ride of claim 10 wherein the deformable material comprises an air bag, and further including detecting when the guest has left the ride and re-inflating the air bag.

* * * * *